US009550267B2

(12) United States Patent
Beckman et al.

(10) Patent No.: US 9,550,267 B2
(45) Date of Patent: Jan. 24, 2017

(54) TOOL FOR ABRASIVE FLOW MACHINING OF AIRFOIL CLUSTERS

(71) Applicant: UNITED TECHNOLOGIES CORPORATION, Farmington, CT (US)

(72) Inventors: Micah Beckman, Middletown, CT (US); David Krzysztof Masiukiewicz, Vernon, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 14/765,723

(22) PCT Filed: Dec. 19, 2013

(86) PCT No.: PCT/US2013/076462

§ 371 (c)(1),
(2) Date: Aug. 4, 2015

(87) PCT Pub. No.: WO2014/143302

PCT Pub. Date: Sep. 18, 2014

(65) Prior Publication Data

US 2015/0375360 A1 Dec. 31, 2015

Related U.S. Application Data

(60) Provisional application No. 61/800,697, filed on Mar. 15, 2013, provisional application No. 61/904,124, filed on Nov. 14, 2013.

(51) Int. Cl.

| | |
|---|---|
| ***B24B 31/10*** | (2006.01) |
| ***B24B 31/116*** | (2006.01) |
| ***B24B 19/14*** | (2006.01) |

(52) U.S. Cl.
CPC ..... *B24B 31/116* (2013.01); *B24B 19/14* (2013.01)

(58) Field of Classification Search
CPC ..... B24B 31/116; B24B 19/14
USPC ..... 451/29, 36
See application file for complete search history.

(56) References Cited

U.S. PATENT DOCUMENTS 5,486,281 A * 1/1996 Gruver ..... C25D 5/022 205/110
5,562,404 A * 10/1996 Koff ..... F01D 5/145 415/173.7
5,644,394 A * 7/1997 Owens ..... B23P 6/002 15/324
5,702,288 A * 12/1997 Liebke ..... B24B 31/116 451/113

(Continued)

OTHER PUBLICATIONS

International Search Report Application No. PCT/US2013/076462; reported on Apr. 10, 2014.

(Continued)

*Primary Examiner* — George Nguyen
(74) *Attorney, Agent, or Firm* — Cantor Colburn LLP

(57) ABSTRACT

A tool for use during the abrasive flow polishing of an airfoil cluster in an abrasive flow machine is described. The tool may comprise a body and prongs extending from the body. Each prong of the tool may be configured to insert between an adjacent pair of airfoils of the airfoil cluster to create at least one channel therebetween. The channel may allow the flow of an abrasive media therethrough.

20 Claims, 7 Drawing Sheets

(56) References Cited

U.S. PATENT DOCUMENTS

| | | | | |
|---|---|---|---|---|
| 5,716,192 | A * | 2/1998 | Phillips | F01D 5/187 415/115 |
| 6,180,262 | B1 * | 1/2001 | Freling | C23C 4/02 415/173.1 |
| 7,303,461 | B1 | 12/2007 | Campomanes et al. | |
| 2004/0266320 | A1 | 12/2004 | Walch | |
| 2005/0215686 | A1 * | 9/2005 | Fernihough | C23C 8/04 524/430 |
| 2007/0023142 | A1 * | 2/2007 | LaGraff | C23C 10/02 156/345.31 |
| 2011/0189924 | A1 | 8/2011 | Erickson | |

OTHER PUBLICATIONS

Yadav, Sunil Kumar et al., Effect of Unconventional Machining on Surface Roughness of Metal: Aluminum and Brass—A case Study of Abrasive Flow, samriddhi, 2011. vol. 2, pp. 53-60.

* cited by examiner

TOOL FOR ABRASIVE FLOW MACHINING OF AIRFOIL CLUSTERS

CROSS-REFERENCE TO RELATED APPLICATION

This patent application is a US National Stage under 35 U.S.C. §371, claiming priority to International Application No. PCT/US2013/076462 filed on Dec. 19, 2013, which claims priority under 35 U.S.C. §119(e) to U.S. Patent Application Ser. Nos. 61/904,124 filed on Nov. 14, 2013 and 61/800,697 filed on Mar. 15, 2013.

FIELD OF DISCLOSURE

The present disclosure generally relates to tools for abrasive flow polishing and, more specifically, relates to tools for abrasive flow polishing of airfoil clusters for gas turbine engines.

BACKGROUND

Abrasive flow polishing is a process that may be used for the surface polishing of metal parts prior to their distribution. The method has been found to be advantageous for the surface finishing and polishing of manufactured parts having complex structural features such as internal passages and/or buried cavities that are difficult to access by other surface finishing techniques. The process may take place in an abrasive flow machine that passes a thick abrasive media back and forth over the surfaces and through any internal passages and/or cavities of a part. The abrasive flow machine may have a fixture to hold the part in a cylinder and it may have pistons to pump the abrasive media back and forth over the part being retained in position by the fixture.

Abrasive flow polishing has been employed as a manufacturing step in the production of surface finished airfoil clusters for gas turbine engines. The airfoil clusters may consist of a plurality of airfoils attached to a supporting rail to form a unitary structure. Due to the complex structural features of airfoil clusters, surface polishing by abrasive flow machining may be more effective than some other polishing methods which may fail to polish hard to reach surfaces of the airfoil cluster to a desired degree.

While abrasive flow machining of airfoil clusters may be an effective method for the surface polishing of airfoil clusters, differential finishing (or uneven surface polishing) of airfoil clusters may occur in some cases. In particular, current fixtures for abrasive flow polishing of airfoil clusters are designed to hold the part in position but may do little to control and guide the flow and velocity of the abrasive media over hard to reach areas of the part. As a result, certain surfaces of the airfoil cluster may receive more surface polishing and more difficult to reach surfaces may be left with non-conforming surface roughness. The hard to reach areas may include the concave surfaces of the airfoils, the root radii of the airfoils, and the platforms located on the support rail between each adjacent pair of airfoils. Moreover, current abrasive flow polishing methods may direct abrasive media directly at the certain regions of the airfoils (e.g., the leading edges) and this may lead to abrasive wear and structural damage in some cases.

Although one approach described in U.S. Patent Application number 2011/0047777 employs a mask to cover and protect specific regions of the airfoil cluster from contact with the abrasive media during abrasive flow machining, strategies for regulating the flow of abrasive media over the surfaces of the airfoil cluster to provide targeted surface polishing are still wanting. Clearly, a system is needed to control the direction and velocity of abrasive media flow over the surfaces of airfoil clusters during abrasive flow processes to ensure that targeted areas (i.e., the platforms and root radii of the airfoils) are polished to desired specifications.

SUMMARY OF THE DISCLOSURE

In accordance with one aspect of the present disclosure, a tool for use during the abrasive flow machining of an airfoil cluster is disclosed. The tool may comprise a body and prongs extending from the body. Each of the prongs may be configured to insert between an adjacent pair of airfoils of the airfoil cluster to create at least one channel therebetween. The channel may allow the flow of an abrasive media therethrough.

In another refinement, the at least one channel may include a first capillary channel and a second capillary channel. The first capillary channel may be formed between the prong and a convex surface of a first airfoil of the adjacent pair of airfoils, and the second capillary channel may be formed between the prong and a concave surface of a second airfoil of the adjacent pair of airfoils.

In another refinement, the at least one channel may further include a platform channel formed between the tip of the prong and a platform of the airfoil cluster. The platform may be located on a supporting rail of the airfoil cluster between the adjacent pair of airfoils.

In another refinement, a channel width of the platform channel may be greater than a channel width of each of the first capillary channel and the second capillary channel.

In another refinement, a velocity of the abrasive media may be greater in the platform channel than in each of the first capillary channel and the second capillary channel.

In another refinement, each prong of the tool may have a convex surface and a concave surface.

In another refinement, the convex surface of the prong may have a curvature identical to the curvature of the convex surface of the first airfoil, and the concave surface of the prong may have a curvature identical to the curvature of the concave surface of the second airfoil.

In another refinement, the first capillary channel may be formed between the concave surface of the prong and the convex surface of the first airfoil, and the second capillary channel may be formed between the convex surface of the prong and the concave surface of the second airfoil.

In another refinement, the abrasive media may follow a curved pathway when flowing through the first capillary channel and the second capillary channel and the curved pathway may have a curvature matching the curvatures of the first airfoil and the second airfoils.

In another refinement, the channel width of the platform channel may be up to about two times greater than the channel widths of each of the first capillary channel and the second capillary channel.

In another refinement, the channel width of the platform channel may be about equal to the channel widths of each of the first capillary channel and the second capillary channel.

In another refinement, the channel width of the platform channel may be less than the channel widths of each of the first capillary channel and the second capillary channel.

In accordance with another aspect of the present disclosure, an abrasive flow machine for polishing the surfaces of an airfoil cluster is disclosed. The abrasive flow machine may comprise a housing, an abrasive media contained in the housing, and a driver operatively associated with the abrasive media to cause the abrasive media to flow over the surfaces of the airfoil cluster. The abrasive flow machine may further comprise a tool configured to operatively associate with the airfoil cluster. The tool may have a body and prongs extending from the body. Each of the prongs may be configured to insert between an adjacent pair of airfoils of the airfoil cluster to create at least one channel therebetween. The channel may allow the flow of the abrasive media therethrough.

In another refinement, the at least one channel may include a first capillary channel and a second capillary channel. The first capillary channel may be formed between the prong and a convex surface of a first airfoil of the adjacent pair of airfoils and the second capillary channel may be formed between the prong and a concave surface of a second airfoil of the adjacent pair of airfoils.

In another refinement, the at least one channel may further include a platform channel formed between a tip of the prong and a platform of the airfoil cluster. The platform may be located on a supporting rail of the airfoil cluster between the adjacent pair of airfoils.

In another refinement, a channel width of the platform channel may be greater than a channel width of each of the first capillary channel and the second capillary channel.

In another refinement, each prong of the tool may have a convex surface and a concave surface.

In another refinement, the first capillary channel may be formed between the concave surface of the prong and the convex surface of the first airfoil and the second capillary channel may be formed between the convex surface of the prong and the concave surface of the second airfoil.

In accordance with another aspect of the present disclosure, a method for using a tool for the abrasive flow machining of an airfoil cluster is disclosed. The method may comprise assembling the airfoil cluster with the tool by inserting a prong of the tool between an adjacent pair of airfoils of the airfoil cluster to create at least one channel therebetween. The channel may allow the flow of an abrasive media therethrough. The method may further comprise initiating the flow of the abrasive media through the at least one channel. The curvature and widths of the channel may assist in controlling the direction and velocity of the flow of the abrasive media over surfaces of the airfoil cluster.

In another refinement, the at least one channel may include a first capillary channel, a second capillary channel, and a platform channel. The first capillary channel may be formed between the prong and a surface of a first airfoil of the adjacent pair of airfoils, and the second capillary channel may be formed between the prong and a surface of a second airfoil of the adjacent pair of airfoils. The platform channel may be formed between a tip of the prong and a platform of the airfoil cluster. The platform may be located on a supporting rail of the airfoil cluster between the adjacent pair of airfoils.

These and other aspects and features of the present disclosure will be more readily understood when read in conjunction with the accompanying drawings.

It should be understood that the drawings are not necessarily drawn to scale and that the disclosed embodiments are sometimes illustrated diagrammatically and in partial views. In certain instances, details which are not necessary for an understanding of this disclosure or which render other details difficult to perceive may have been omitted. It should be understood, of course, that this disclosure is not limited to the particular embodiments disclosed herein.

DETAILED DESCRIPTION

Figure 1:
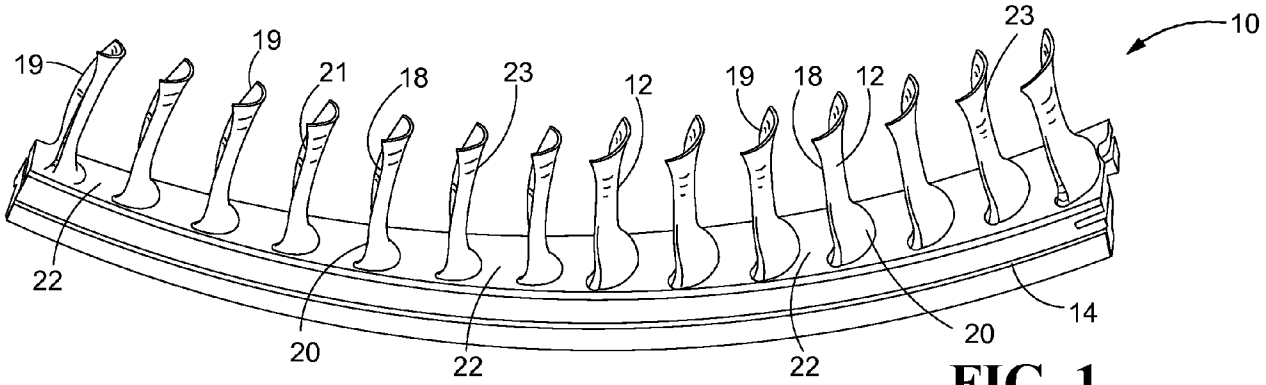
FIG. 1 is a front perspective view of an airfoil cluster, constructed in accordance with the present disclosure.

Referring now to the drawings, and with specific reference to FIG. 1, an airfoil cluster 10 is shown. The airfoil cluster 10 may consist of a plurality of airfoils 12 attached to a supporting rail 14 to form an integral piece or a unitary structure. Alternatively, the airfoils 12 and the supporting rail 14 may be formed separately and may assemble to form the airfoil cluster 10. In any event, each of the airfoils 12 may have a leading edge 18, a trailing edge 19, and a root radii 20 near the base of the airfoils 12, as shown. In addition, each of the airfoils 12 may have a concave surface 21 (pressure side of airfoil) and a convex surface 23 (suction side of airfoil). Between each adjacent pair of airfoils 12 may be a platform 22 along the upper surface of the support rail 14, as shown.

Figure 2:
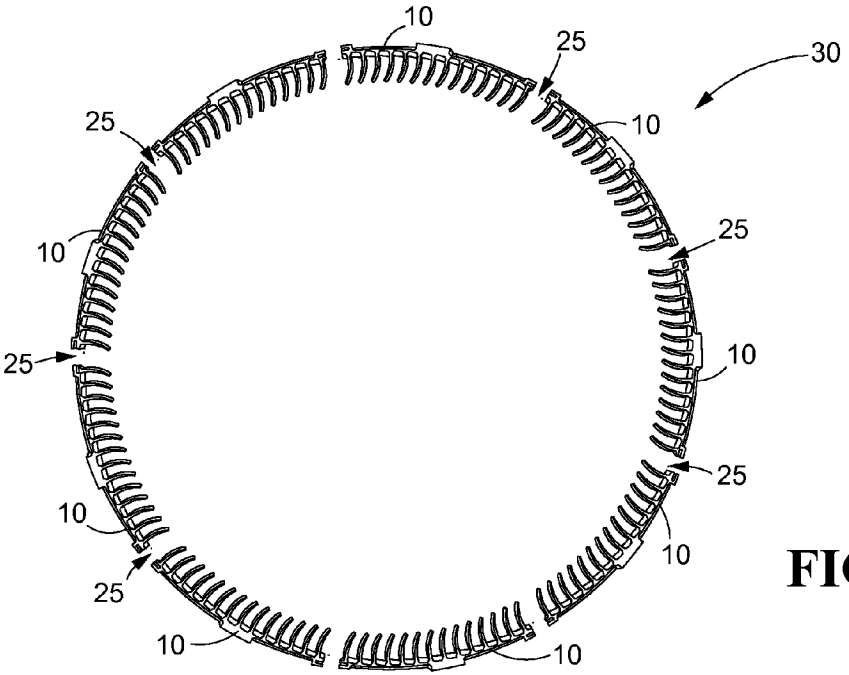
FIG. 2 is a front view of an airfoil assembly formed from several of the airfoil clusters of FIG. 1, constructed in accordance with the present disclosure.

A plurality of the airfoil clusters 10 may assemble and connect to each other at connection points 25 to form an airfoil assembly 30 which may have an annular structure, as shown in FIG. 2. As one possibility, nine airfoil clusters 10 may assemble to form the airfoil assembly 30. Alternatively, the airfoil assembly 30 may consist of other numbers of airfoil clusters or a single ring-like airfoil cluster. The airfoil assembly 30 may form a stage of a high pressure compressor of a gas turbine engine, as will be understood by those with ordinary skill in the art. For example, the airfoil assembly 30 may be a stator vane assembly forming one stage. Alternatively, the airfoil assembly 30 may be a component of another region of a gas turbine engine such as, but not limited to, the rotor blades or stator vanes of the low pressure compressor or the high or low pressure turbine sections, as will be apparent to those skilled in the art.

The airfoil clusters 10 may be formed from metal and may be manufactured by a process apparent to those skilled in the art such as direct metal laser sintering (DMLS), a 3D printing technique, or another manufacturing method chosen by a skilled artisan. Following manufacture, in some circumstances, certain regions of the airfoil cluster 10 such as the platforms 22 and the root radii 20 may have rough surfaces. In order to bring the surface roughness of the airfoil cluster 10 to a desired smoothness and/or to remove excess material to meet part specifications and quality regulations, the airfoil cluster 10 may require surface polishing prior to distribution and incorporation into the airfoil assembly 30 and the gas turbine engine. Ideally, such surface polishing would target areas of the airfoil cluster 10 that may be characterized by high surface roughness following manufacture (i.e., the platforms 22 and the root radii 20). It is in this regard that the present disclosure greatly improves over the prior art (see further details below).

Figure 3:
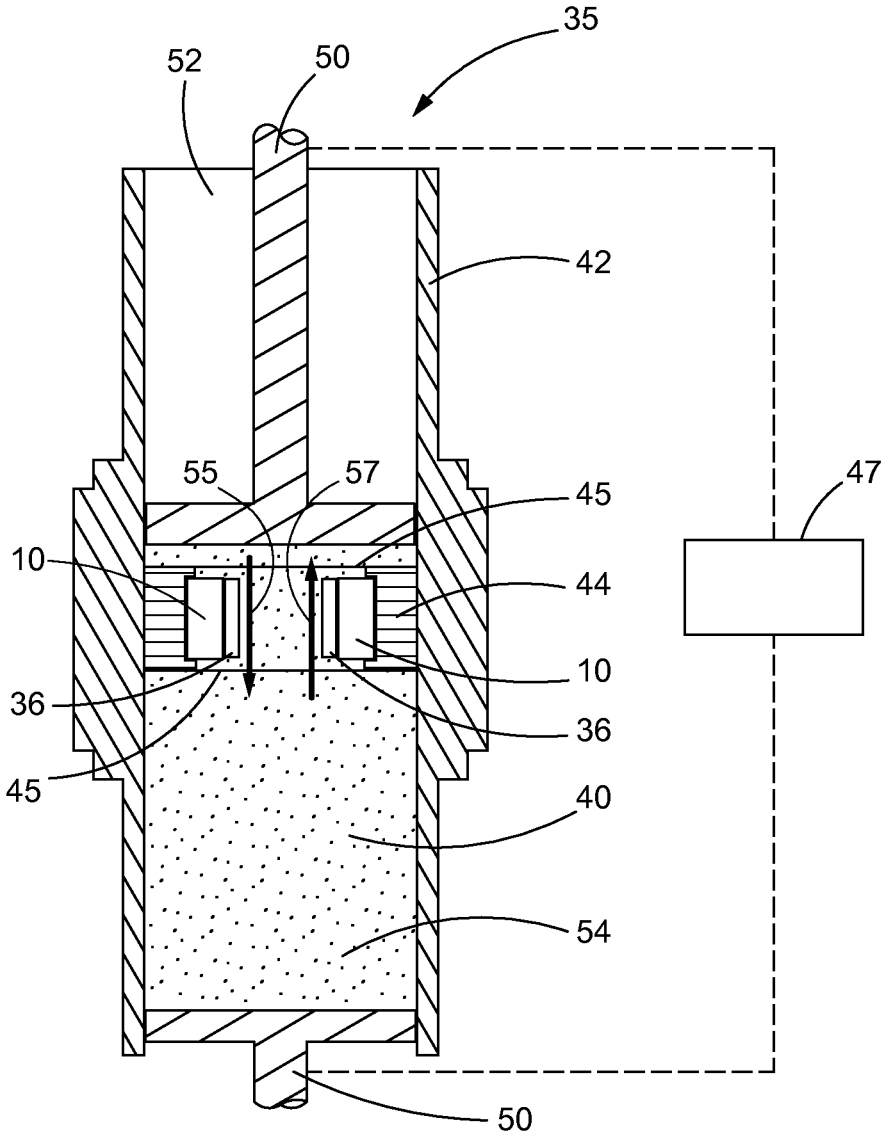
FIG. 3 is a cross-sectional view of an abrasive flow machine with tools for polishing the airfoil clusters of the airfoil assembly, constructed in accordance with the present disclosure.

FIG. 3 shows an abrasive flow machine 35 for the abrasive flow polishing of one or more of the airfoil clusters 10 after a casting operation or other manufacturing process. In some situations, the abrasive flow machine 35 may be configured to simultaneously polish all of the airfoil clusters designated for incorporation into an airfoil assembly 30 (see FIG. 2). Importantly, in the abrasive flow machine 35, each of the airfoil clusters 10 may be assembled with a tool 36 which may be configured to assist in regulating the flow mechanics, flow velocity, and the flow path (directionality of flow) of an abrasive media 40 over the surfaces of the airfoil clusters 10 during the abrasive flow polishing process. In particular, the tools 36 may be configured to target polishing activity at surfaces of the airfoil clusters 10 that may be characterized by high surface roughness following manufacture (e.g., root radii, platforms, etc.) (see further details below).

The abrasive flow machine 35 may consist of a housing 42 for containing an abrasive media 40. The abrasive media 40 may have a thick, gel-like or putty-like consistency and it may be permeated with an abrasive material that may act to abrade and polish the surfaces of the airfoil clusters 10, although other types of abrasive media are also possible. The abrasive flow machine 35 may also have a fixture 44 that may be configured to retain each of the airfoil clusters 10 and the tools 36 in static position during the abrasive flow polishing process. Optional plates 45 that allow the flow of the abrasive media 40 therethrough may be positioned above and below (i.e., opposite sides of) the fixture 44 to further assist retention of the airfoil clusters 10 and the tools 36 during abrasive flow machining. The abrasive flow machine 35 may also have a driver 47 to cause the abrasive media 40 to flow over the surfaces of the airfoil clusters 10. The driver 47 may drive two pistons 50 to direct the abrasive media 40 back and forth in a reciprocating motion between an upper chamber 52 and a lower chamber 54 of the housing 42. In operation, the pistons 50 may direct the abrasive media 40 in a forward direction 55, causing the abrasive media 40 to flow from the upper chamber 52 to the lower chamber 54, and then in a reverse direction 57, causing the abrasive media 40 to flow from the lower chamber 54 to the upper chamber 52. During this process, the abrasive media 40 may flow back and forth over the surfaces of the airfoil clusters 10.

Figure 4:
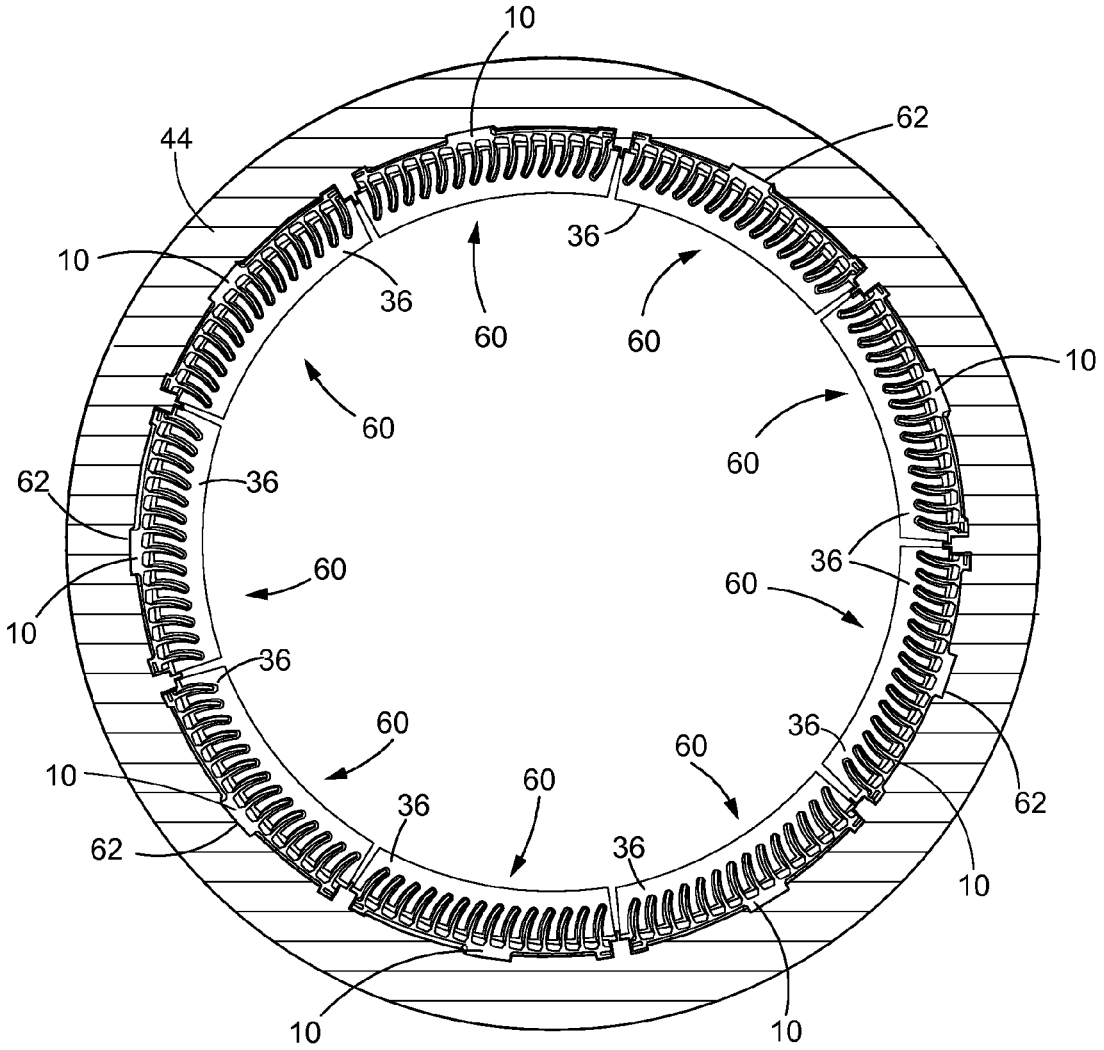
FIG. 4 is a top view of assemblies of the tools and the airfoil clusters as retained by a fixture in the abrasive flow machine, constructed in accordance with the present disclosure.

One tool 36 may be associated with one of the airfoil clusters 10 to form an assembly 60 and the fixture 44 may retain a plurality of the assemblies 60 during abrasive flow polishing, as best shown in FIG. 4. The fixture 44 may optionally have a plurality of cavities 62 configured to receive a respective one of the assemblies 60 and assist retaining them in static position during the polishing process.

Figure 5:
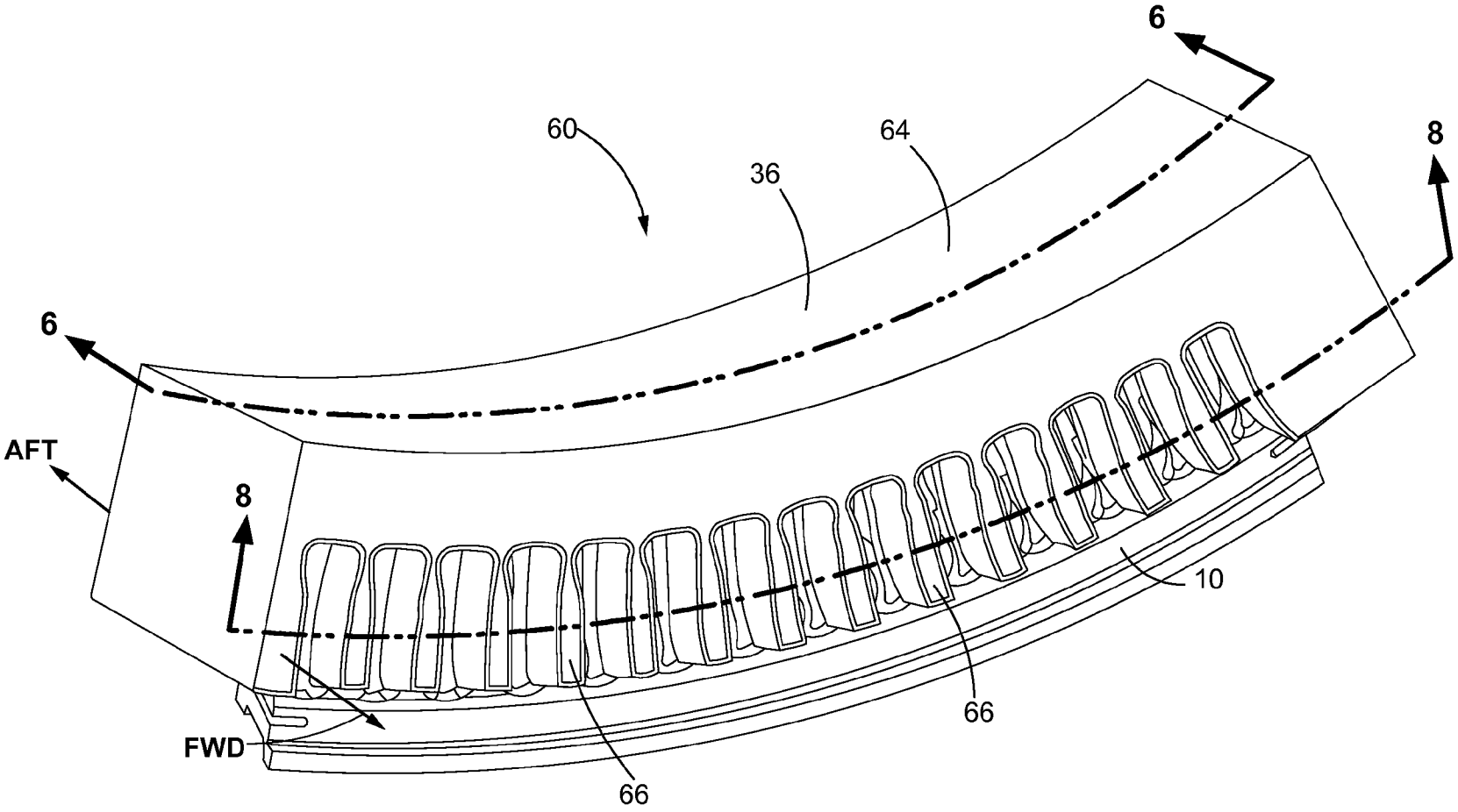
FIG. 5 is a front perspective view of an assembly of the tool and the airfoil cluster, constructed in accordance with the present disclosure.
Figure 7:
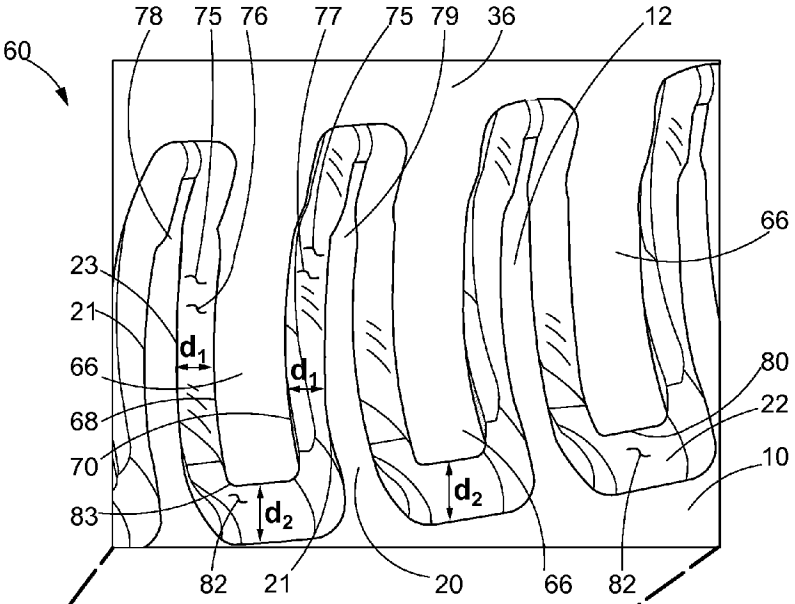
FIG. 7 is a front perspective view of area 7 of FIG. 6.
Figure 6:
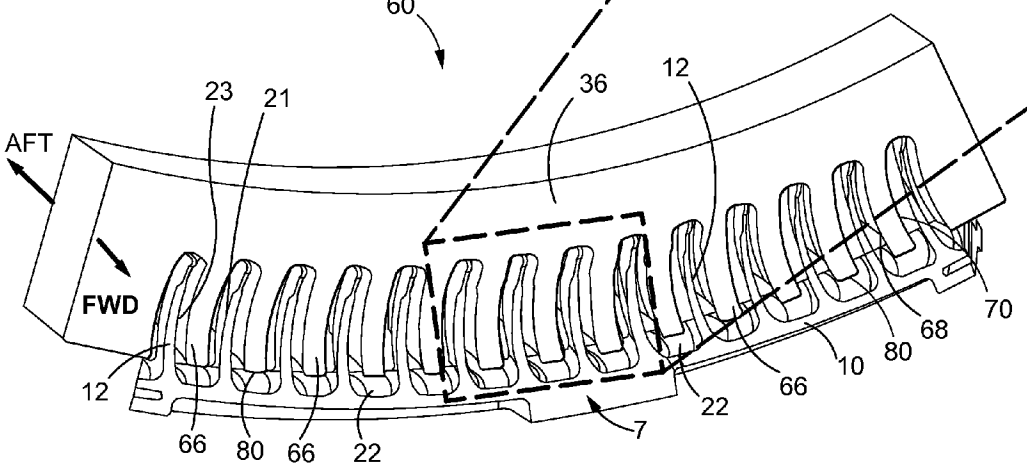
FIG. 6 is a cross-sectional view of the assembly of FIG. 5 taken along the line 6-6 of FIG. 5, constructed in accordance with the present disclosure.

More detailed views of the assembly 60 between the tool 36 and the airfoil cluster 10 are shown in FIGS. 5-7. The tool 36 may have a comb-like structure including a body 64 from which a plurality of prongs 66 may extend. Each prong 66 may be dimensioned to insert between an adjacent pair of airfoils 12 of the airfoil cluster 10 leaving spaces therebetween, as best shown in the cross-sectional views of FIGS. 6 and 7. More specifically, each of the prongs 66 may be configured to insert between the convex surface 23 of one airfoil 12 and the concave surface 21 of an immediately adjacent airfoil 12 without coming into physical contact with the concave and convex surfaces of the airfoils. Furthermore, as best shown in FIG. 5, the prongs 66 may have a length (from forward to aft) that exceeds the length of each of the airfoils (as measured from the leading edge 18 to the trailing edge 19). In addition, each of the prongs 66 may have a concave surface 68 and a convex surface 70 each having a shape and curvature identical to, or at least substantially identical to, the concave surfaces 21 and the convex surfaces 23 of the airfoils 12, respectively (see FIG. 6). In this regard, the tool 36 may be custom designed according to the geometries of the airfoils 12 of the airfoil cluster 10. Alternatively, the curvature of the prongs 66 may deviate somewhat from the curvature of the concave surfaces 21 and the convex surfaces 23 of the airfoils, such that the tool 36 will not require custom-fabrication for each subtle variance in airfoil curvature and geometry.

As best shown in FIG. 7, when assembled with the airfoil cluster 10 in the assembly 60, each of the prongs 66 of the tool 36 may define two capillary channels 75 between the prong 66 and the concave and convex surfaces of the adjacent pair of airfoils. The two capillary channels 75 may include a first capillary channel 76 formed between the concave surface 68 of the prong 66 and the convex surface 23 of a first airfoil 78, and a second capillary channel 77 formed between the convex surface 70 of the prong and the concave surface 21 of a second airfoil 79, wherein the first airfoil 78 and the second airfoil 79 are immediately adjacent airfoils in the airfoil cluster 10. Each of the capillary channels 75 in the assembly 60 may have the same diameter (or channel width), $d_1$, or they may have different diameters. Importantly, each of the capillary channels 75 in the assembly 60 may define a flow channel allowing the flow of the abrasive media 40 therethrough during the abrasive flow polishing process and they may control the velocity of the abrasive media 40 over the concave surfaces 21, the convex surfaces 23, the leading edges 18, and the trailing edges 19 of each of the airfoils 12 (see further details below). In addition, the widths, $d_1$, of the capillary channels 75 may be fixed along the length (from forward to aft) of the capillary channels 75 and this arrangement may assist in providing uniform flow velocities of the abrasive media 40 across the surfaces of the airfoils 12. The channel widths, $d_1$, of the capillary channels 75 may vary depending on the polishing specifications of the airfoil cluster 10 as well as on the consistency of the abrasive media 40. As a non-limiting possibility, the channel widths, $d_1$, of the capillary channels 75 may be about 0.07 inches (about 1.8 mm), but may be larger than this for more viscous abrasive media or smaller for less viscous abrasive media.

In addition, each of the prongs 66 of the tool 36 may have a tip portion 80 that, when assembled with the airfoil cluster 10 in the assembly 60, may be positioned away from one of the platforms 22 to define a platform channel 82 therebetween, as best shown in FIG. 7. The abrasive media 40 may flow through the platform channels 82 during the abrasive flow polishing process and the platform channels 82 may assist in controlling the velocity of the flow of the abrasive media 40 over the surfaces of both the platforms 22 and the root radii 20. Furthermore, the concave and convex surfaces (68 and 70) may have a definition at the radius of an edge 83 that they share with the surface 80 of the tool 36. The definition may be modified as necessary to adjust the flow of the abrasive media 40 over the root radii 20.

Each of the platform channels 82 may have a channel width, $d_2$, as measured by the distance from the tip portion 80 of the prongs to the platform 22, as shown in FIG. 7. In one possible arrangement, the channel widths, $d_2$, of each of the platform channels 82 in the assembly 60 may be wider than the channel widths, $d_1$, of the capillary channels 75. As a non-limiting possibility, the channel width, $d_2$, of the platform channel 82 may be up to about two times greater than the capillary channels 75. For example, the platform channel 82 may be about 0.14 inches (about 3.6 mm) wide, but other channel widths are certainly possible depending on the airfoil cluster geometry and/or the viscosity of the abrasive media 40. In addition, in some circumstances, the channel widths, $d_2$, of the platform channels 82 may be equal to or less than the channel widths, $d_1$, of the capillary channels 75.

When assembled with the airfoil cluster 10 as the assembly 60, the tool 36 may assist in targeting certain surfaces of the airfoil cluster 10 for enhanced polishing. More specifically, given that the velocity of the flow of the abrasive media 40 through the capillary channels 75 and the platform channels 82 may be directly correlated with the channel widths ($d_1$ and $d_2$) and that the platform channels 82 may be wider than the capillary channels 75 (see FIG. 7), the abrasive media 40 may flow with higher velocities in the platform channels 82 than in the capillary channels 75 during the abrasive flow polishing process. Consequently, the surfaces of the airfoil cluster 10 that are located in the platform channels 82 (i.e., the platforms 22 and the root radii 20) may experience greater abrasive work and enhanced polishing as compared to the surfaces located in the capillary channels 75 (i.e., the concave surfaces 21, the convex surfaces 23, the leading edges 18, and the trailing edges 19). As can be appreciated, the tool 36 may also have alternative configurations creating different flow channel geometries to direct enhanced abrasive activity to other selected regions of the airfoil cluster 10, if desired.

Figure 8:
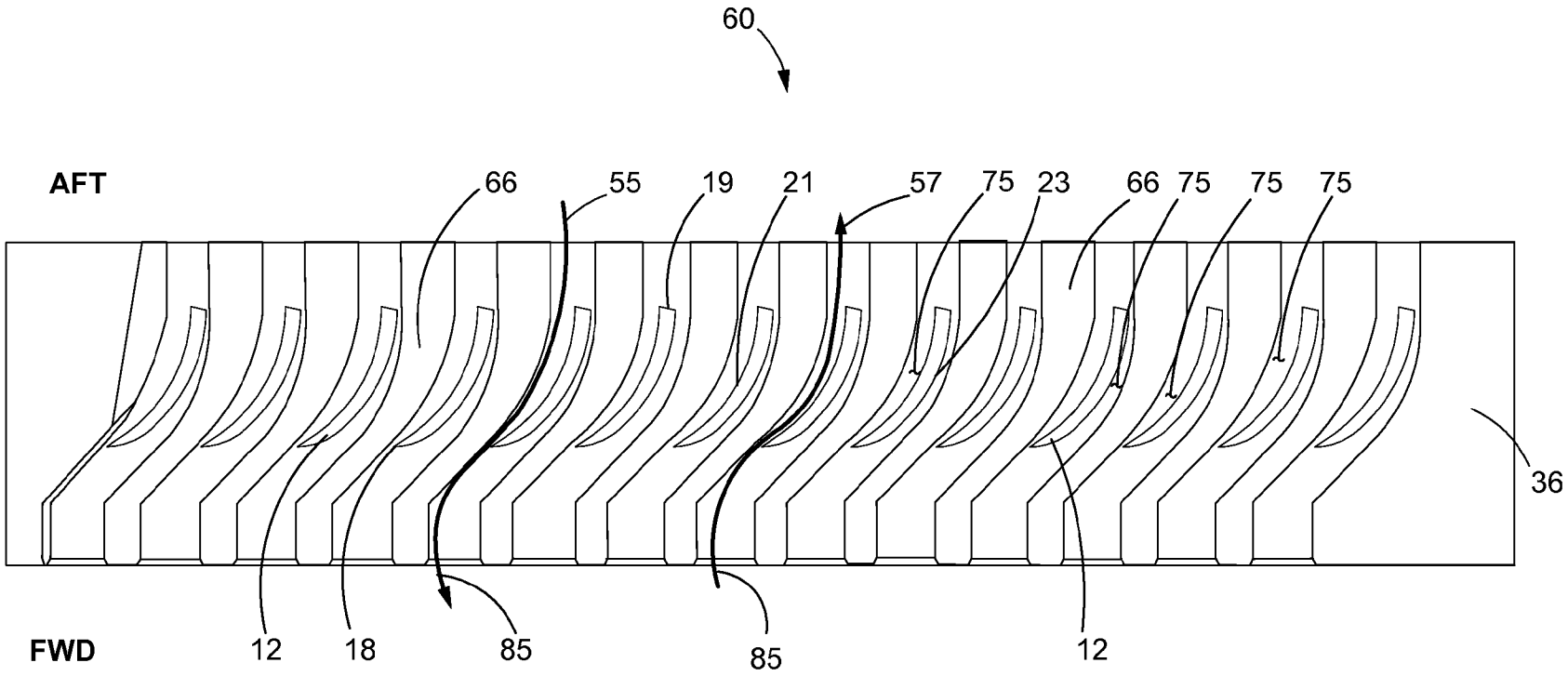
FIG. 8 is bottom cross-sectional view through the section 8-8 of FIG. 5, schematically illustrating the flow of abrasive media through capillary channels of the assembly, in accordance with the present disclosure.

FIG. 8 schematically depicts the flow direction of the abrasive media 40 across the airfoils 12 while passing through the capillary channels 75 of the assembly 60 during abrasive flow polishing in the abrasive flow machine 35. Each of the capillary channels 75 may have a curvature that matches, or at least substantially matches, the curvature of the concave and convex surfaces of the airfoils 12. Accordingly, the flow of the abrasive media 40 in both the forward direction 55 and the reverse direction 57 may follow a curved pathway 85 having a curvature that matches, or at least substantially matches, the curvature of each of the airfoils 12. Moreover, the fixed diameters of the capillary channels 75 ($d_1$) and the platform channels 82 ($d_2$) may provide uniform flow velocities along the length (forward to aft) of the capillary channels 75 and the platform channels 82, respectively. This arrangement may assist in evening flow velocities and preventing appreciable accelerations and decelerations of the abrasive media 40 when passing over the surfaces of the airfoils 12, thereby assisting to reduce structural damage to the surfaces of the airfoils 12 and the leading edges 18.

The tool 36 may be formed from a plastic material, such as nylon or a glass-impregnated nylon, or another suitable material. Furthermore, the tool 36 may be formed by a three-dimensional printing method or another manufacturing method chosen by a skilled artisan.

Figure 9:
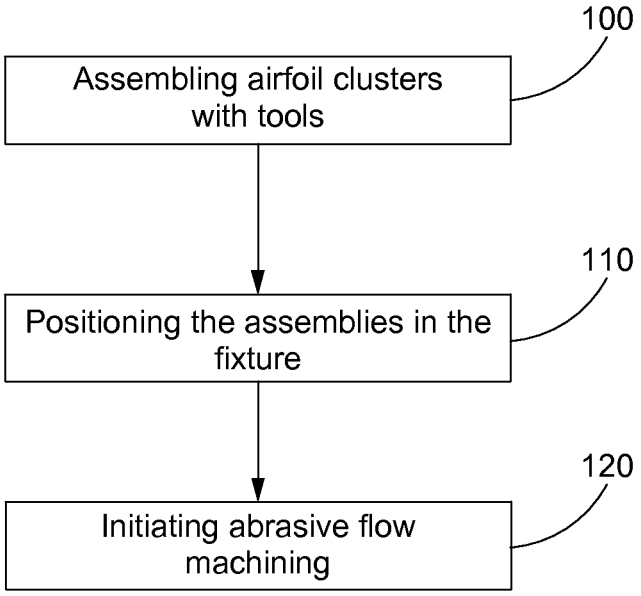
FIG. 9 is a flow chart diagram, illustrating steps involved in using the tool for abrasive flow polishing of the airfoil cluster, in accordance with a method of the present disclosure.

A method for using the tool 36 for the abrasive flow polishing of an airfoil cluster 10 is shown in FIG. 9. Beginning with the first block 100, an airfoil cluster 10 that is designated for polishing may be assembled with the tool 36 by inserting each prong 66 of the tool 36 between a respective one of an adjacent pair of airfoils 12 to form the assembly 60, as best shown in FIGS. 5-7. The assembling of the airfoil cluster 10 with the tool 36 in this way may define channels (or spaces) between the airfoil cluster 10 and the tool 36 which may allow the flow of the abrasive media 40 therethrough. The channels may be the capillary channels 75 and the platform channels 82, as best shown in FIG. 7, or other types of channels depending on the design of the tool 36 and/or the geometry and polishing requirements of the airfoil cluster 10. If the abrasive flow machine 35 is used to carry out abrasive flow polishing, one or more of the assemblies 60 may be positioned in the fixture 44 according to a next block 110, as shown. According to a next block 120, the flow of the abrasive media 40 may be initiated, as shown. Once the flow of the abrasive media is initiated, the curvature and widths of the channels (which may vary depending on the design of the tool) may assist in controlling the direction and velocity of the flow of the abrasive media 40 over the surfaces of the airfoil cluster in order to target specific regions (e.g., the platforms 22 and the root radii 20) of the airfoil cluster for enhanced abrasion and polishing and/or to assist preventing abrasive wear on selected regions of the airfoil.

INDUSTRIAL APPLICABILITY

From the foregoing, it can therefore be seen that the present disclosure can find industrial applicability in many situations, including, but not limited to, abrasive flow polishing of airfoil clusters for gas turbine engines. The technology disclosed herein provides a tool that may be introduced into an abrasive flow machine to control the flow direction and flow velocities of abrasive media over the surfaces of an airfoil cluster. Specifically, the diameter of the flow channels between the tool and the surfaces of the airfoils of the airfoil cluster may be adjusted in order to target certain surfaces of the airfoil cluster for enhanced abrasive activity and polishing. As disclosed herein, the targeted surfaces may include the platforms and the root radii of the airfoils, which are areas of the airfoil clusters that are frequently characterized by greater roughness following manufacture and are difficult to polish to desired specifications using current abrasive flow machining techniques. Furthermore, by virtue of the fixed flow channel diameters between the tool and the airfoil cluster, the tool may also prevent appreciable accelerations and decelerations of the flow of the abrasive media over the surfaces of the airfoil cluster, thereby preventing uneven abrasive wear on the airfoils. Therefore, the technology disclosed herein may find wide industrial applicability in areas such as, but not limited to, improved manufacturing processes for airfoil clusters for gas turbine engines.

While only certain embodiments have been set forth, alternative embodiments and various modifications will be apparent from the above descriptions to those skilled in the art. These and other alternatives are considered equivalents and within the spirit and scope of this disclosure.

What is claimed is:

1. A tool for the abrasive flow machining of an airfoil cluster, comprising:

a body; and prongs extending from the body, each prong being configured to insert between an adjacent pair of airfoils of the airfoil cluster to create at least one channel therebetween, the channel allowing the flow of an abrasive media therethrough.

2. The tool of claim 1, wherein the at least one channel includes a first capillary channel and a second capillary channel, the first capillary channel being formed between the prong and a convex surface of a first airfoil of the adjacent pair of airfoils, the second capillary channel being formed between the prong and a concave surface of a second airfoil of the adjacent pair of airfoils.

3. The tool of claim 2, wherein the at least one channel further includes a platform channel formed between a tip of the prong and a platform of the airfoil cluster, the platform being located on a supporting rail of the airfoil cluster between the adjacent pair of airfoils.

4. The tool of claim 3, wherein a channel width of the platform channel is greater than a channel width of each of the first capillary channel and the second capillary channel.

5. The tool of claim 4, wherein a velocity of the abrasive media is greater in the platform channel than in each of the first capillary channel and the second capillary channel.

6. The tool of claim 4, wherein each prong has a convex surface and a concave surface.

7. The tool of claim 6, wherein the convex surface of the prong has a curvature identical to the curvature of the convex surface of the first airfoil, and wherein the concave surface of the prong has a curvature identical to the curvature of the concave surface of the second airfoil.

8. The tool of claim 7, wherein the first capillary channel is formed between the concave surface of the prong and the convex surface of the first airfoil, and wherein the second capillary channel is formed between the convex surface of the prong and the concave surface of the second airfoil.

9. The tool of claim 8, wherein the abrasive media follows a curved pathway when flowing through the first capillary channel and the second capillary channel, the curved pathway having a curvature matching the curvatures of the first airfoil and the second airfoil.

10. The tool of claim 8, wherein the channel width of the platform channel is at least two times greater than the channel width of each of the first capillary channel and the second capillary channel.

11. The tool of claim 3, wherein a channel width of the platform channel is about equal to a channel width of each of the first capillary channel and the second capillary channel.

12. The tool of claim 3, wherein a channel width of the platform channel is thinner than a channel width of each of the first capillary channel and the second capillary channel.

13. An abrasive flow machine for polishing the surfaces of an airfoil cluster, comprising:

a housing;

an abrasive media contained in the housing;

a driver operatively associated with the abrasive media to cause the abrasive media to flow over the surfaces of the airfoil cluster; and a tool configured to operatively associate with the airfoil cluster, the tool having a body and prongs extending from the body, each prong being configured to insert between an adjacent pair of airfoils of the airfoil cluster to create at least one channel therebetween, the channel allowing the flow of the abrasive media therethrough.

14. The abrasive flow machine of claim 13, wherein the at least one channel includes a first capillary channel and a second capillary channel, the first capillary channel being formed between the prong and a convex surface of a first airfoil of the adjacent pair of airfoils, the second capillary channel being formed between the prong and a concave surface of a second airfoil of the adjacent pair of airfoils.

15. The abrasive flow machine of claim 14, wherein the at least one channel further includes a platform channel formed between a tip of the prong and a platform of the airfoil cluster, the platform being located on a supporting rail of the airfoil cluster between the adjacent pair of airfoils.

16. The abrasive flow machine of claim 15, wherein a channel width of the platform channel is greater than a channel width of each of the first capillary channel and the second capillary channel.

17. The abrasive flow machine of claim 15, wherein each prong has a convex surface and a concave surface.

18. The abrasive flow machine of claim 17, wherein the first capillary channel is formed between the concave surface of the prong and the convex surface of the first airfoil and the second capillary channel is formed between the convex surface of the prong and the concave surface of the second airfoil.

19. A method for using a tool for the abrasive flow machining of an airfoil cluster, comprising:

assembling the airfoil cluster with the tool by inserting a prong of the tool between an adjacent pair of airfoils of the airfoil cluster to create at least one channel therebetween, the channel allowing the flow of an abrasive media therethrough; and initiating the flow of the abrasive media through the at least one channel, the curvature and widths of the channel assisting to control the direction and velocity of the flow of the abrasive media over surfaces of the airfoil cluster.

20. The method of claim 19, wherein the at least one channel includes a first capillary channel, a second capillary channel, and a platform channel, the first capillary channel being formed between the prong and a surface of a first airfoil of the adjacent pair of airfoils, the second capillary channel being formed between the prong and a surface of a second airfoil of the adjacent pair of airfoils, the platform channel being formed between a tip of the prong and a platform of the airfoil cluster, the platform being located on a supporting rail of the airfoil cluster between the adjacent pair of airfoils.

* * * * *